United States Patent [19]

Berrangé

[11] 3,945,748

[45] Mar. 23, 1976

[54] COMPACTION BY SUPERIMPOSING IMPACT FORCES ON A PRELOADED AREA OF SOIL

[75] Inventor: Aubrey R. Berrangé, Pretoria, Transvaal, South Africa

[73] Assignee: Compaction Technology (Proprietary) Limited, Wynberg, South Africa

[22] Filed: May 13, 1974

[21] Appl. No.: 469,680

[52] U.S. Cl. ..... 404/117; 404/122

[51] Int. Cl.[2] ..... E01C 19/38

[58] Field of Search ..... 404/122, 117, 72, 133; 301/31; 180/20

[56] References Cited

UNITED STATES PATENTS

| | | | |
|---|---|---|---|
| 1,364,605 | 1/1921 | Ashmore, et al. | 404/117 |
| 2,054,851 | 9/1936 | Dornfeld | 404/133 |
| 2,344,701 | 3/1944 | Hutchinson | 404/117 |
| 2,440,585 | 4/1948 | Hutchinson | 404/117 |
| 2,908,206 | 10/1959 | Melanson | 404/133 |
| 2,909,106 | 10/1959 | Berrange | 404/133 X |
| 3,291,014 | 12/1966 | Paramythioti | 404/122 |
| 3,472,135 | 10/1969 | Nevitt | 404/133 |
| 3,478,656 | 11/1969 | McDonald | 404/122 X |
| 3,703,127 | 11/1972 | Kaltenegger | 404/133 X |

*Primary Examiner*—Nile C. Byers
*Attorney, Agent, or Firm*—Young & Thompson

[57] ABSTRACT

A method of soil compaction consists in, during compaction of the soil, applying a smaller auxiliary force around the area of the soil to which a larger compacting force is applied. In soil compacting apparatus a pneumatic tire is used for applying the auxiliary force and the compacting force is applied by a cylindrical or non-cylindrical compacting member located within the tire, the compacting member being adapted to contact the inner surface of the tire for applying the compacting force to the soil. In another embodiment, the compacting member is mounted adjacent the pneumatic tire on a common axle therewith.

4 Claims, 7 Drawing Figures

COMPACTION BY SUPERIMPOSING IMPACT FORCES ON A PRELOADED AREA OF SOIL

SOIL compacting machines are known which operate by applying impact loads to the soil being compacted. It is found particularly with non-cohesive soils, that a certain amount of soil is displaced from below the rigid compacting face delivering the blows to the soil surface with a consequential loss of the effectiveness of the machine.

It is an object of the present invention to alleviate this difficulty.

According to the invention there is provided a method of compacting soil comprising the step of imparting, during application of a compacting force, an auxiliary force to the soil adjacent an area of the soil to which the compacting force is being applied.

The auxiliary force may conveniently be smaller than the compacting force and the compacting force may be imparted in a series of successive blows to the soil.

Also according to the invention there is provided soil compacting apparatus comprising means for applying a compacting force to an area of the soil to be compacted and means for applying an auxiliary force to an area of the soil adjacent the area to which the compacting force is applied.

A pneumatic tire, when in contact with a soil surface applies a pressure to the soil approximately equivalent to the inflation pressure of the tire. By using a "ballon" type of tire, a large area of soil is confined by the air pressure. Thus, the auxiliary force applying means may comprise a pneumatic tire. The compacting force applying means may comprise a cylindrical compacting member located inside or adjacent to the tire.

In another embodiment, the compacting member may be noncylindrical and adapted for applying a series of successive blows to the soil surface. In a further embodiment, the compacting force applying means may comprise a fluid filled annular tube located inside the pneumatic tire and being concentric therewith. The fluid may be a liquid or air.

The invention will now be described, by way of examples, with reference to the accompanying drawings, in which.

Figure 1:
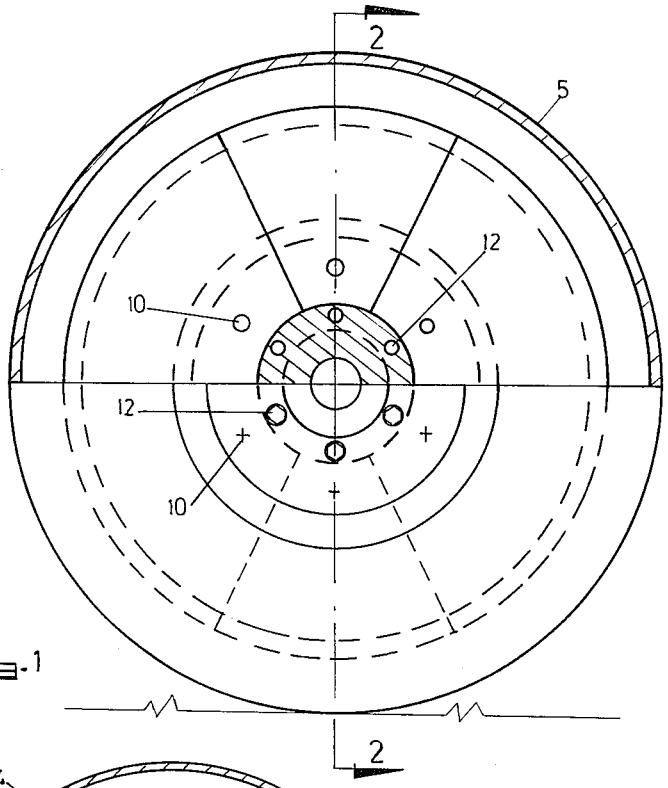
FIG. 1 is a side view of a balloon type pneumatic tire of a soil compacting apparatus fitted with a rigid cylindrical compacting member therein, part sectioned.
Figure 2:
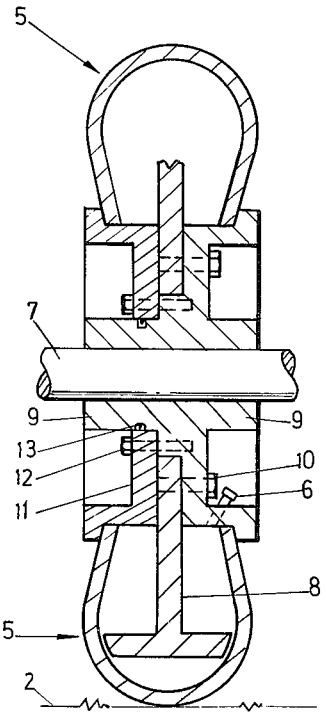
FIG. 2 is a section taken along the lines II—II in FIG. 1 showing the compacting member in a non-operative position.
Figure 3:
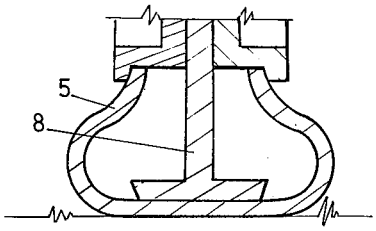
FIG. 3 is a part-sectional view of the apparatus of FIG. 2 showing the compacting member in an operative position in which a soil compacting blow is delivered.

Referring to FIGS. 1 to 3, a pneumatic tire 5 rests on the ground surface 2. When compressed air is introduced into the tire through air valve 6 the area of contact between tire 5 and ground surface diminishes and the wheel axle 7 rises relative to the ground.

In the deflated condition of the tire, a cylindrically shaped compacting member 8 mounted within the tire 5 makes contact with the inner surface of the tire 5 and applies pressure to the ground surface 2. A proportion of the load of the whole wheel is carried by the air pressure within the tire, and a proportion by member 8. (See FIG. 3).

It is made possible to mount cylindrical member 8 within the tire by dividing member 8 into a number of segments, each of which is mounted separately on the wheel hub 9, and secured thereto by means of a bolt 10.

An annular shaped member 11 is bolted to the wheel hub 9 by bolts 12, and suitably sealed by an 'O' ring 13 against escape of air, to form, with the wheel hub 9, a rim in which tire 5 is retained.

In use, the tire 5 is deflated to a suitable extent so that the compacting member 8 contacts the inner surface of the tire, and the tire is then moved across the ground to be compacted. For transporting the apparatus from one location to the other, the tire is inflated so that the compacting member does not contact the inner surface of the tire.

Figure 4:
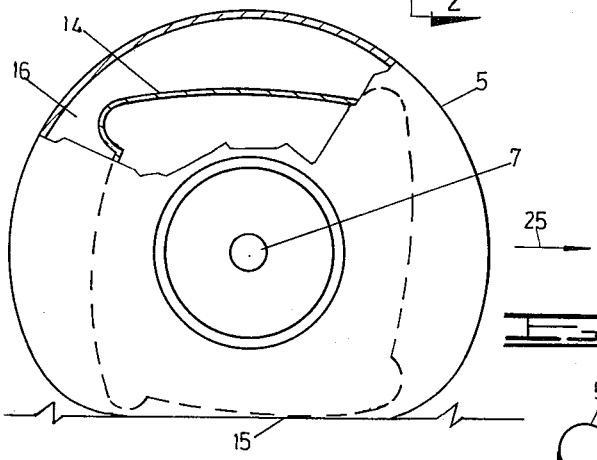
FIG. 4 is a part-sectional side view of another embodiment of soil compacting apparatus in which the rigid compacting member is non-cylindrical.

Referring to FIG. 4 in order to increase the magnitude of the forces acting upon the ground surface 2, the axle of the wheel is induced to rise and fall as the wheel rolls over the ground surface, and the pressure inside the tire 5 is adjusted so that the tire deforms sufficiently to allow cam shaped member 14 to strike the inner surface of the tire 5 at point 15. At this point 15, and the area of contact between tire 5 and ground surface 2 immediately surrounding point 15, dynamic loading is applied to the soil surface 2. Because of the confining effect on the soil produced by the uniformly distributed pressure of the tire active on the ground surface 2, a high impact force may be applied by rigid member 14 striking the inner face of tire 5 at point 15, without the soil displacing under the influence of the dynamic forces.

The shape of member 14 is similar to the cross-sectional shape of conventional impact compactors. As the wheel rolls in the direction shown by the arrow 25, the cam shaped portion 16 of member 14 induces the axle 7 of the wheel to rise relative to the ground surface 2. The energy thus stored is available for producing dynamic force when member 14 comes into contact with the inner surface of tire 5 as the wheel continues to roll.

Figure 5:
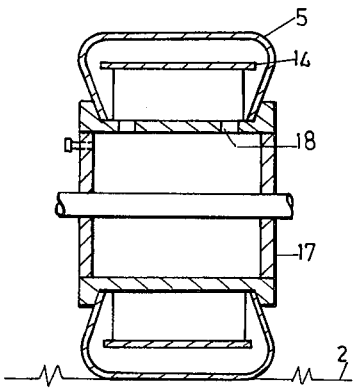
FIG. 5 is a sectional view of soil compacting apparatus similar to FIG. 4 but embodying a flat profile tire.

Referring now to FIG. 5, in order to spread the load of the wheel mass over a wider surface of contact between surface 2 and tire 5 than is possible with a conventional pneumatic tire, a flat profile tyre may be used. The cam shaped member 14 may be correspondingly wider and thus the dynamic forces spread over a wider area.

It is necessary in applying the technique described above, to have a natural frequency of bounce of the pneumatic tire system which will match the frequency with which member 14 contacts the inner face of the tire 5. The desired natural frequency may be attained by using a back-up volume of air such as contained within the wheel structure 17. Apertures 18 allow air to pass freely between the tire interior and the back-up volume.

Figure 6:
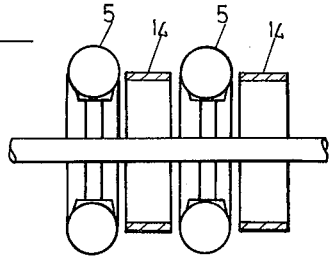
FIGS. 6 and 7 are fragmentary sectional views showing two further embodiments of soil compacting apparatus according to the invention.

In FIG. 6, alternate placement of a pneumatic tire 5 and rigid surface 14 is shown, to provide some confinement of soil while impact is produced. The tires 5 and the members 14 are mounted on a common axle.

Figure 7:
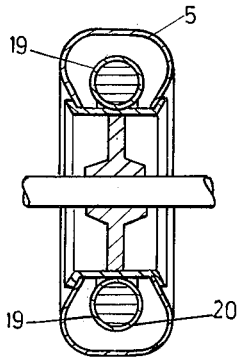

In the embodiment shown in FIG. 7, rigid member 14 of previous embodiments is replaced by a fluid filled annular tube 19 within tire 5. When air pressure 5 is reduced, tube 19 makes contact with inner portion of tire 5 at point 20, but being fluid filled, load is spread.

I claim:

1. Soil compacting apparatus comprising means for applying a compacting force to an area of the soil to be compacted and means for applying an auxiliary force to an area of the soil enclosing the area to which the compacting force is applied, in which the auxiliary force applying means comprises a pneumatic tire and the compacting force applying means comprises a cylindrical compacting member within the tire, the cylindrical member being concentric with the tire and having a width which is smaller than the width of the track of the tire when in contact with the ground and the compacting member being arranged to contact the inner surface of the tire and thereby to impart a compacting force to the ground as the tire is moved across the ground.

2. Soil compacting apparatus according to claim 1, wherein the compacting member is rigid.

3. Soil compacting apparatus according to claim 1, wherein the compacting member comprises a fluid filled annular tube.

4. Soil compacting apparatus comprising means for applying a compacting force to an area of the soil to be compacted and means for applying an auxiliary force to an area of the soil enclosing the area to which the compacting force is applied, wherein the auxiliary force applying means comprises a pneumatic tire and the compacting force applying means comprises a rigid non-cylindrical compacting member within the tire, the compacting member and the tire being mounted for rotation about a common axle and wherein the non-cylindrical member is adapted to impart a series of successive blows against the inner surface of the tire as the tire is rolled across the soil to be compacted.

* * * * *